US006113710A

United States Patent [19]

Kato et al.

[11] Patent Number: 6,113,710

[45] Date of Patent: Sep. 5, 2000

[54] FERRITIC STAINLESS STEEL PLATE EXCELLENT IN DEEP DRAWABILITY AND ANTI-RIDGING PROPERTY AND PRODUCTION METHOD THEREOF

[75] Inventors: Yasushi Kato; Takumi Ujiro; Susumu Satoh, all of Chiba, Japan

[73] Assignee: Kawasaki Steel Corporation, Japan

[21] Appl. No.: 09/269,295

[22] PCT Filed: Aug. 4, 1998

[86] PCT No.: PCT/JP98/03469

§ 371 Date: Mar. 29, 1999

§ 102(e) Date: Mar. 29, 1999

[87] PCT Pub. No.: WO99/07909

PCT Pub. Date: Feb. 18, 1999

[30] Foreign Application Priority Data

Aug. 5, 1997 [JP] Japan ..... 9-210534

[51] Int. Cl.[7] ..... C22C 38/24; C22C 38/26; C21D 8/04

[52] U.S. Cl. ..... 148/325; 148/609

[58] Field of Search ..... 148/325, 609

[56] References Cited

U.S. PATENT DOCUMENTS 4,515,644 5/1985 Sawatani et al. ..... 148/608

5,868,875 2/1999 Yashitake ..... 148/325

*Primary Examiner*—Deborah Yee

*Attorney, Agent, or Firm*—Austin R. Miller

[57] ABSTRACT

The present invention provides a ferritic stainless steel plate improved in the deep drawability and the anti-ridging property at deep drawing work and the production technique thereof. The practical construction of the present invention is a ferritic stainless steel plate containing from 0.001 to 0.015 wt. % C, not more than 1.0 wt. % Si, not more than 1.0 wt. % Mn, not more than 0.05 wt. % P, not more than 0.010 wt. % S, from 8 to 30 wt. % Cr, not more than 0.08 wt. % Al, from 0.005 to 0.015 wt. % N, not more than 0.0080 wt. % O, not more than 0.25 wt. % Ti with Ti/N≧12, and from 0.05 to 0.10 wt. % (Nb+V) with V/Nb being from 2 to 5, and, if necessary, further containing one or more kinds selected from not more than 2.0 wt. % Mo, not more than 1.0 wt. % Ni, and not more than 1.0 wt. % Cu together with one or more kinds selected from from 0.0005 to 0.0030 wt. % B, from 0.0007 to 0.0030 wt. % Ca and from 0.0005 to 0.0030 wt. % Mg. Furthermore, in the production method of the present invention, the above-described ferritic stainless steel plate is produced by heating the steel slab made up of the above-described components to a temperature range of 1170° C. or lower, finishing rough hot rolling of the slab at a temperature range of 950° C. or higher, and then carrying out hot finish-rolling.

9 Claims, 6 Drawing Sheets

FERRITIC STAINLESS STEEL PLATE EXCELLENT IN DEEP DRAWABILITY AND ANTI-RIDGING PROPERTY AND PRODUCTION METHOD THEREOF

This application is a 371 of PCT/JP98/03469 filed Aug. 4, 1998.

TECHNICAL FIELD

The present invention relates to a ferritic stainless steel plate particularly excellent in the deep drawability and the anti-ridging property in ferritic stainless steel plates.

BACKGROUND ART

Ferritic stainless steel has been widely utilized in various industrial fields such as house wares, parts of motorcars, etc., as a material excellent in the corrosion resistance and the heat resistance.

The ferritic stainless steel is inexpensive as compared with an austenitic stainless steel containing a large amount of Ni but in general, is inferior in the workability and, for example, when press working is applied to a ferritic stainless steel, a surface defect called ridging is liable to cause, thereby the ferritic stainless steel is unsuitable for the use of being applied with a strong work such as a deep drawing work, etc.

Also, a ferritic stainless steel has the problems that the anisotropy ($\Delta r$) of a plastic strain ratio is large and a nonuniform deformation is liable to cause at deep drawing work.

Now, for solving the above-described problems, many attempts have hitherto been made. First, various improvements of an anti-ridging property are proposed in (a) Patent Publication (unexamined) No. 52-24913, (b) Patent Publication (unexamined) No. 56-123356, (c) Patent Publication (unexamined) No. 7-18385, (d) Patent Publication (unexamined) No. 9-53155, etc.

The stainless steel of the above-described (a) contains from 0.03 to 0.08 wt. % C, not more than 0.01 wt. % N, not more than 0.008 wt. % S, not more than 0.03 wt. % P, not more than 0.4 wt. % Si, not more than 0.5 wt. % Mn, not more than 0.3 wt. % Ni, from 15 to 20 wt. % Cr, and from 2×N to 0.2 wt. % Al.

The stainless steel of the above-described (b) contains not more than 0.1 wt. % C, not more than 1.0 wt. % Si, not more than 0.75 wt. % Mn, from 10 to 30 wt. % Cr, not more than 0.5 wt. % Ni, not more than 0.025 wt. % N, and from 2 to 30 ppm of B or further containing one or more kinds from 0.005 to 0.4 wt. % Al, from 0.005 to 0.6 wt. % Ti, from 0.005 to 0.4 wt. % Nb, from 0.005 to 0.4 wt. % V, from 0.005 to 0.4 wt. % Zr, from 0.02 to 0.5 wt. % Cu, not more than 0.05 wt. % Ca, and not more than 0.05 wt. % Ce.

In the stainless steel of the above-described (c), the content of Cr is from 3 to 60 wt. %, the contents of C, S, and O are reduced, and the content of N is from 0.03 to 0.5 wt. %.

The stainless steel of the above-described (d) contains not more than 0.01 wt. % C, not more than 1.0 wt. % Si, not more than 1.0 wt. % Mn, not more than 0.01 wt. % S, from 9 to 50 wt. % Cr, not more than 0.07 wt. % Al, not more than 0.02 wt. % N, not more than 0.01 wt. % O, and C and N in the conditions satisfying $N(wt.\%)/C(wt.\%) \geqq 2$ and $0.006 \leqq [C(wt.\%)+N(wt.\%)] \leqq 0.025$, and further Ti in the conditions satisfying $\{Ti(wt.\%)-2\times S(wt.\%)-3\times O(wt.\%)\}/[C(wt.\%)+N(wt.\%)] \geqq 4$ and $[Ti(wt.\%)]\times[N(wt.\%) \leqq 30\times10^{-4}$.

However, in these techniques, when a severe deep drawing work is carried out, ridging occurs and thus they cannot say sufficient techniques. Also, there is a problem that the occurrence of a nonuniform deformation at a drawing work is not improved.

On the other hand, as a technique of improving the anisotropy of the plastic strain ratio, a ferritic stainless steel containing not more than 0.03 wt. % C, not more than 1.0 wt. % Si, not more than 1.0 wt. % Mn, not more than 0.05 wt. % P, not more than 0.015 wt. % S, not more than 0.1 wt. % Al, not more than 0.02 wt. % N, from 5 to 60 wt. % Cr, from 4×(C+N) to 0.5 wt. % Ti, from 0.003 to 0.02 wt. % Nb, and from 0.0002 to 0.005 wt. % B or further containing at least one kind of from 0.0005 to 0.01 wt. % Ca and from 0.1 to 5.0 wt. % Mo is disclosed in (e) Patent Publication (unexamined) No. 8-20843.

By the technique, certainly, Ar becomes about 0.15 or lower and the anisotropy is improved but the anti-ridging property is insufficient.

Also, techniques of improving the deep drawability are disclosed in (f) Patent Publication (unexamined) No. 8-260106 and (g) Patent Publication 8-26436.

In the above-described (f), by adding a slight amount of Nb, $\Delta r$ is reduced and further by adding V, the yield ratio is lowered and in the above-described (g), by making appropriate the addition amounts of Ti, Nb, and B, the drawability and the surface characteristics are improved.

However, it is hard to say that both the techniques are the techniques of sufficiently satisfying the workability and further, in the portions subjected to a severe deep drawing work, the problem of the generation of ridging is not sufficiently improved.

As described above, in the ferritic stainless steels by the conventional techniques, the deep drawability and the anti-ridging property have not yet been improved to a sufficient level and particularly, when a severe deep drawing work is applied, there is a problem that ridging occurs.

In view of the circumstances of the conventional techniques, an object of the present invention is to provide a ferritic stainless steel plate having both the improved deep drawability and the improved anti-ridging property at a deep drawing work and a production technique thereof.

Also, other object of the present invention is to provide a ferritic stainless steel plate having the deep drawability satisfying the characteristics of the r value of not less than 1.8 and $\Delta r$ of not more than 0.15 and having the excellent anti-ridging property, and the production technique thereof.

DISCLOSURE OF INVENTION

As the result of various investigations of producing a ferritic stainless steel plate capable of being applied with a severe deep drawing work and also scarcely causing ridging even in the case, the present inventors have discovered that by particularly selecting the component composition or by properly combining the component composition and the hot rolling condition, the above-described objects can be achieved and have accomplished the present invention. That is, the present invention is as follows.

A 1st aspect of aspect of the present invention is a ferritic stainless steel plate excellent in the deep drawability and the anti-ridging property, comprising from 0.001 to 0.015% by weight C, not more than 1.0% by weight Si, not more than 1.0% by weight Mn, not more than 0.05% by weight P, not more than 0.010% by weight S, from 8 to 30% by weight Cr, not more than 0.08% by weight Al, from 0.005 to 0.015% by weight N, not more than 0.0080% by weight O, not more than 0.25% by weight Ti which satisfies Ti/N≧12, and from 0.05 to 0.10% by weight (Nb+V) which satisfy V/Nb≧2 to 5, rest being Fe and unavoidable impurities.

A 2nd aspect of the present invention is a ferritic stainless steel plate excellent in the deep drawability and the anti-ridging property of the 1st aspect wherein the ferritic stainless steel plate further contains one or more kinds of not more than 2.0% by weight Mo, not more than 1.0% by weight Ni, and not more than 1.0% by weight Cu.

A 3rd aspect of the present invention is a ferritic stainless steel plate excellent in the deep drawability and the anti-ridging property of the 1st aspect wherein the ferritic stainless steel plate further contains one or more kinds of from 0.0005 to 0.0030% by weight B, from 0.0007 to 0.0030% by weight Ca, and from 0.0005 to 0.0030% by weight Mg.

A 4th aspect of the present invention is a ferritic stainless steel plate excellent in the deep drawability and the anti-ridging property of the 1st aspect wherein the ferritic stainless steel plate further contains one or more kinds of not more than 2.0% by weight Mo, not more than 1.0% by weight Ni, and not more than 1.0% by weight Cu and also contains one or more kinds of from 0.0005 to 0.0030% by weight B, from 0.0007 to 0.0030% by weight Ca, and from 0.0005 to 0.0030% by weight Mg.

A 5th aspect of the present invention is a production method of a ferritic stainless steel plate excellent in the deep drawability and the anti-ridging property, which comprises, in the case of producing the ferritic stainless steel plate described in one of the above-described aspects 1 to 4, heating the steel slab made up of the component composition described in each of the aspects in a temperature range of not more than 1170° C., finishing a hot rough rolling in the temperature range of 950° C. or higher, and successively carrying out a hot finishing rolling.

BEST MODE FOR CARRYING OUT THE INVENTION

Then, the experiment which became of the ground of the present invention is described.

(Experiment 1)

Steels each containing from 0.004 to 0.008 wt. % C, from 0.12 to 0.27 wt. % Si, from 0.27 to 0.35 wt. % Mn, from 0.021 to 0.037 wt. % P, from 0.001 to 0.006 wt. % S, from 16.4 to 16.8 wt. % Cr, from 0.002 to 0.057 wt. % Al, from 0.006 to 0.010 wt. % N, from 0.0027 to 0.0056 wt. % O, and from 0.06 to 0.07 wt. % (Nb+V) with V/Nb=2.4 to 2.8, together with a changed amount of Ti were experimentally melted and by applying hot rolling, annealing, cold rolling, and then finish-annealing, each steel plate of 0.7 mm in thickness was produced.

From the rolling direction of each steel plate obtained, a tensile test piece of JIS No. 5 was sampled and the anti-ridging property of each sample was evaluated from the ridging generated extent at applying a tensile strain of 25%. The smaller evaluation value means that ridging is less. The results are shown in FIG. 1.

Figure 1:
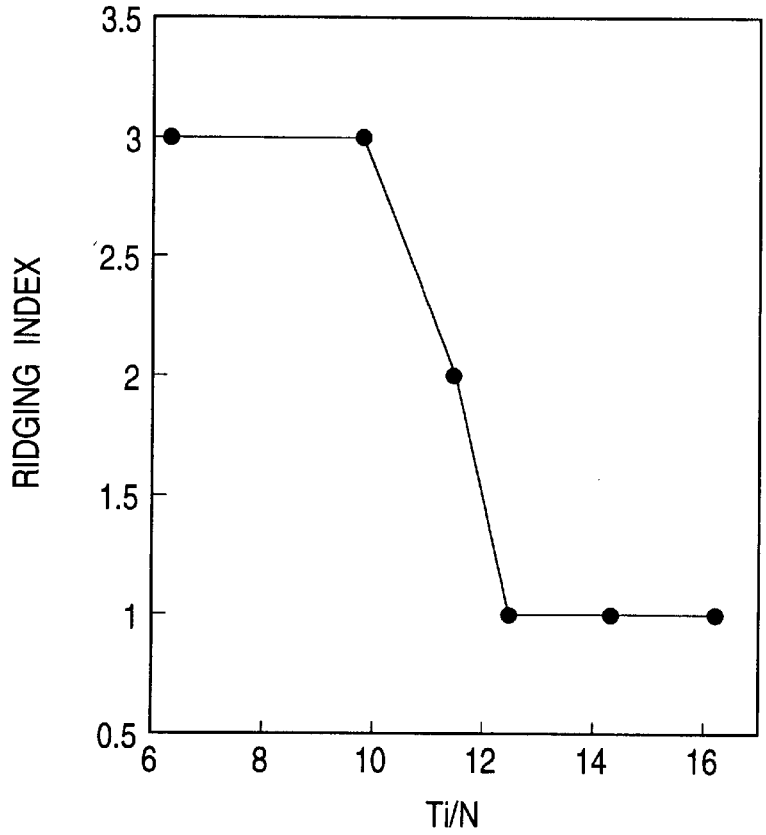
FIG. 1 is a graph showing the influence of Ti/N on the ridging index.

From the results shown in FIG. 1, it can be seen that when Ti/N becomes 12 or higher, the ridging index becomes 1 and ridging scarcely occurs.

(Experiment 2)

In the component systems used in Experiment 1, however, with Ti/N of from 12.6 to 13.9, steels were melted by variously changing the contents of (Nb+V), and by applying hot rolling, annealing, cold rolling, and finish-annealing, each steel plate of 0.7 mm in thickness was produced.

From the rolling direction (L direction) of each steel plate obtained, the direction of 45° (D direction) to the rolling direction, and the direction of 90° (C direction) to the rolling direction, test pieces were sampled and the r value and the Δr were obtained by the following equations.

$$r=(rL+2\ rD+rC)/4$$

$$\Delta r=(rL+rC)/2-rD$$

wherein rL, rD, and rC show the r values of the L direction, the D direction, and C direction respectively.

Figure 2:
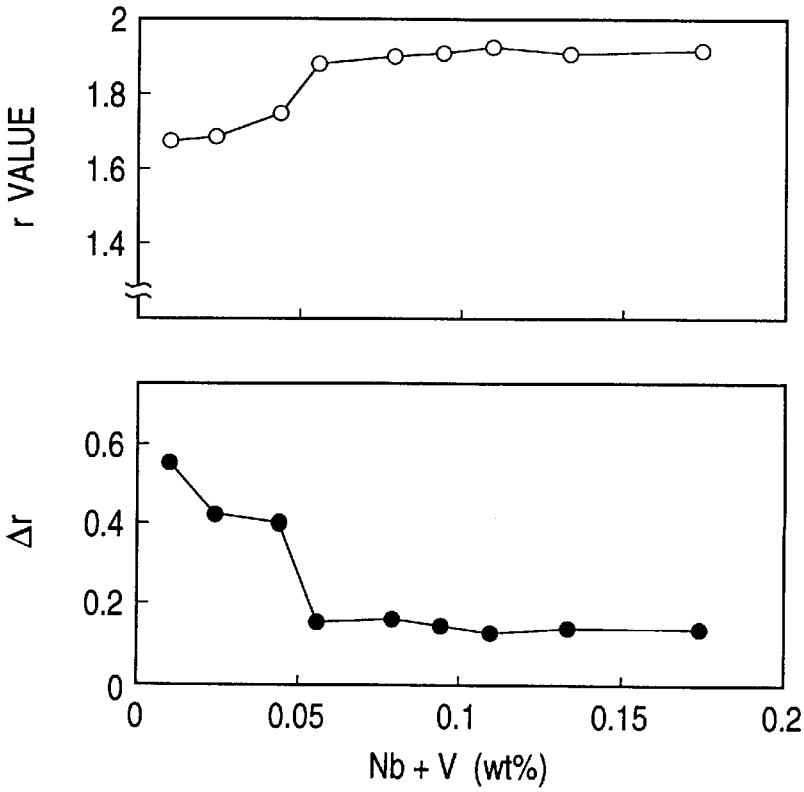
FIG. 2 is a graph showing the influence of (Nb+V) on the r value and Δr.

The results obtained are readjusted with the amount of (Nb+V) and show in FIG. 2. From the results shown in FIG. 2, it can be seen that when the amount of (Nb+V) becomes 0.05% by weight or higher, the r value, which is the index of deep drawability, is increased to about 1.9, at the same time, the Δr, which is an index of the anisotropy, is reduced to about 0.15, and the formability is remarkably improved.

Figure 3:
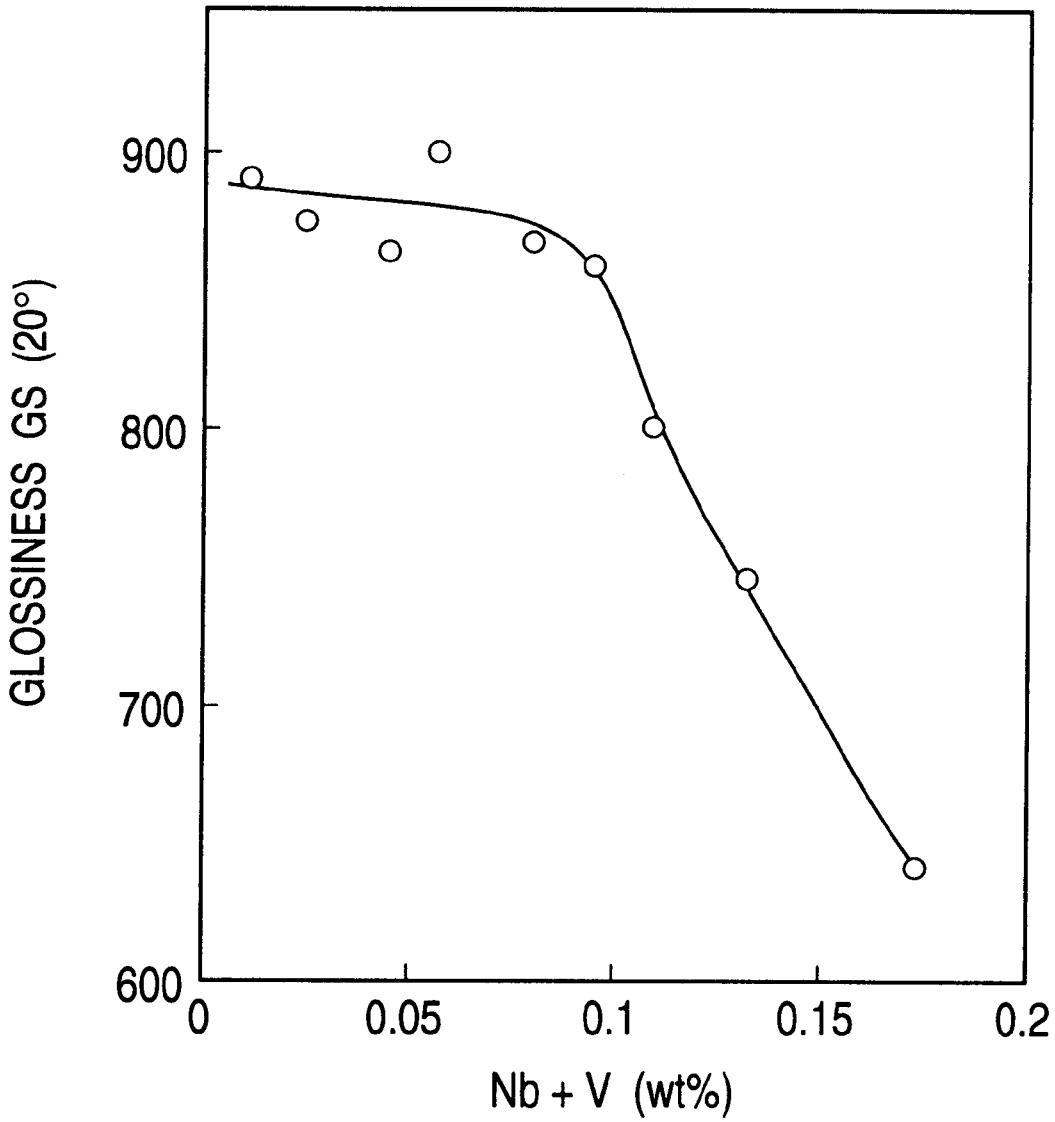
FIG. 3 is a graph showing the influence of (Nb+V) on the glossiness.

On the other hand, the above-described steel plates were subjected to a de-scaling treatment by an electrolysis in an neutral salt solution and dipping in mixed acids and the glossiness of the surface of each steel plate was measured according to the method of JIS Z-8741. The results are readjusted with the amount of (Nb+V) and shown in FIG. 3. From the results shown in FIG. 3, it can be seen that when the amount of (Nb+V) exceeds 0.1% by weight, the glossiness (GS) after de-scaling is greatly lowered. That is, from the point of the glossiness, the upper limit of the amount of (Nb+V) is limited to 0.1% by weight. (Experiment 3) In the composition system used in Example 2 with, however, (Nb+V) of from 0.056 to 0.079 wt. %, steels were melted by variously changing Nb/V, applying hot rolling, annealing, cold rolling, finish-annealing, pickling, and 0.5% skin pass to carry out drawing at a ratio rp/D of the punch shoulder rp to the punch diameter D of 0.15 with various heights, the limiting drawing height of generating ridging at the worked portion was obtained.

Figure 4:
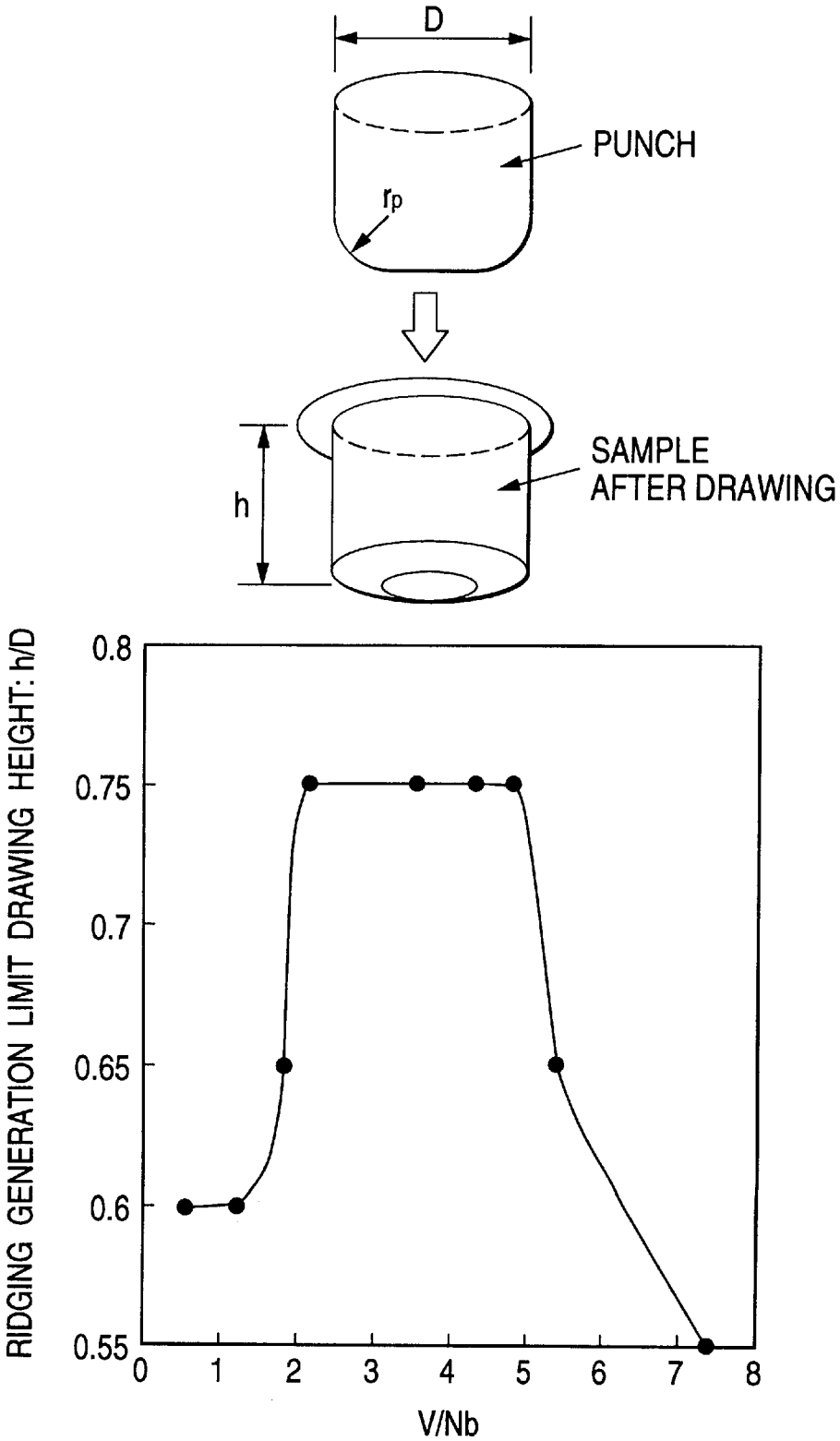
FIG. 4 is a graph showing the influence of V/Nb on the ridging generating limit drawing height.

FIG. 4 shows the adjusted relation of the limiting drawing height and V/Nb. From the results shown in FIG. 4, it can be seen that in the range of V/Nb of from 2 to 5, the limiting drawing height is greatly increased and the anti-ridging property is improved.

Figure 5:
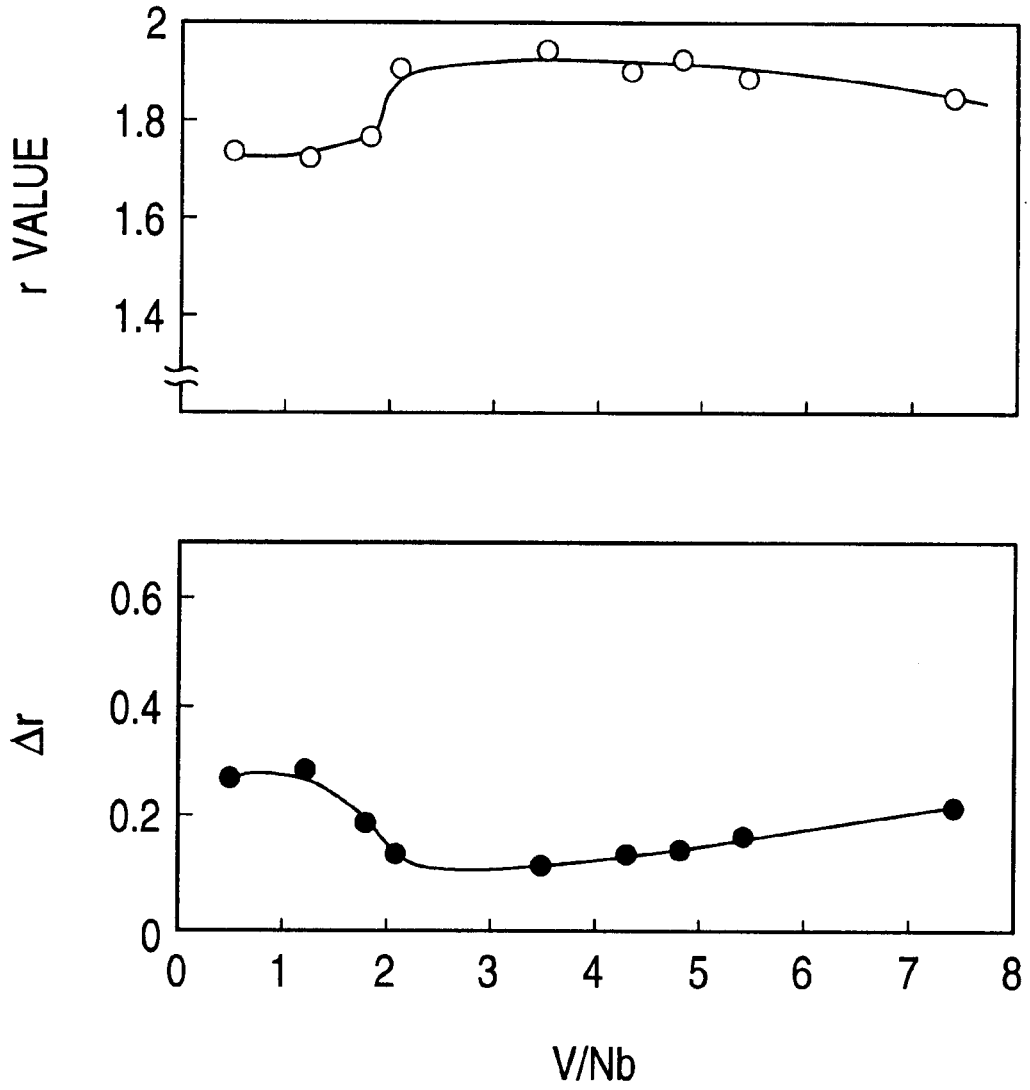
FIG. 5 is a graph showing the influence of V/Nb on the r value and Δr.

FIG. 5 is a graph showing the adjusted relations of the r value, the Δr, and V/Nb of these samples and from the results of FIG. 5, it can be seen that in the range of the value of V/Nb of 2 or higher, the r value is increased, the value of Ar becomes smaller, and the formability is improved.

From the each experimental result, it can be seen that for the improvement of the deep drawability and the anti-ridging property in the case of applying a severe deep drawing work, the conditions of Ti/N≧12, (Nb+V)≧0.05% by weight, and 2≦V/Nb≦5 are necessary and indispensable and further from the point of the glossiness after de-scaling, (Nb+V)≦0.10% by weight is necessary and indispensable.

Then, the limitation reasons of the present invention are explained below.

C: 0.001 to 0.015% by weight

From the points of the formability and the toughness, it is preferred that the content of C is low and because when the content of C exceeds 0.015% by weight, the above characteristics are deteriorated, the upper limit is defined to be 0.015% by weight. On the other hand, when the content of C is too low, there is no problem on the characteristics but when the content is less than 0.001% by weight, the smelting cost becomes large and thus the lower limit is defined to be 0.001% by weight which can be industrially produced.

Si: Not more than 1.0% by weight

Si is an element which acts as a deoxidizer and increases the strength and because when the content of Si exceeds 1.0% by weight, lowering of the ductility cause, the upper limit is defined to be 1.0% weight. In addition, from the points of the balance of the strength, and the ductility, the range of from 0.05 to 0.5% by weight is preferred.

Mn: Not more than 1.0% by weight

Mn is also an element which acts as a deoxidizer and also increases the strength but because the content exceeds 1.0% by weight, the ductility and the corrosion resistance are lowered, the upper limit is defined to be 1.0% by weight. In addition, from the points of the strength, the ductility, and the corrosion resistance, the range of from 0.05 to 0.5% by weight is preferred.

P: Not more than 0.05% by weight

P is an element of deteriorating the ductility and because when the content of P exceeds 0.05% by weight, the influence becomes particularly remarkable, the upper limit thereof is defined to be 0.05% by weight.

S: Not more than 0.010% by weight

S is a harmful element which forms a sulfide to deteriorate the corrosion resistance. Because the content of S exceeds 0.010% by weight, the bad influence becomes remarkable, the upper limit is defined to be 0.010% by weight.

Cr: 8 to 30% by weight

Cr is a useful element which improves the corrosion resistance and the heat resistance of the alloy, when the content of Cr is 8% by weight or higher, the effect becomes large but because when the content exceeds 30% by weight, the ductility is lowered, the content is defined to be the range of from 8 to 30% by weight. The range is more preferably from 10 to 30% by weight.

Al: Not more than 0.08% by weight

Al acts as a deoxidizer but because when the content exceeds 0.08% by weight, the deoxidized product becomes coarse to cause the deterioration of the corrosion resistance and the occurrence of the surface defect, the upper limit is defined to be 0.08% by weight. The lower limit is not established because if the deoxidation is sufficiently carried out, no bad influence occurs.

N: 0.005 to 0.015% by weight

From the points of the elongation, formability, etc., it is preferred that the content of N is low but because when the content of N is not more than 0.015% by weight, there is no considerable problem, the upper limit is defined to be 0.015% by weight. On the other hand, when the content of N is lowered extremely, the anti-ridging property is deteriorated. Because the defect becomes particularly remarkable, the content of N is less than 0.005% by weight, the lower limit is defined to be 0.005% by weight.

O: Not more than 0.0080% by weight

O exists in the form of an oxide in the steel and acts to accelerate the formation of the surface defect and deteriorate the corrosion resistance. When the content exceeds 0.008% by weight, the bad influences become particularly severe and thus the upper limit is limited to 0.008% by weight.

Ti: Not more than 0.25% by weight and Ti/N≧12

Ti is the primary element in the present invention as is clear from the above-described result, because by the addition of Ti satisfying Ti/N≧12, the anti-ridging property is improved, the lower limit of Ti is limited to Ti≧12×N. On the other hand, the addition of a large amount of Ti is accompanied by the occurrence of the surface defect (stringer-form defect) which is considered to be caused by the aggregation and large-sizing of TiN and because the defect becomes severe when the content exceeds 0.25% by weight, the upper limit is defined to be 0.25% by weight.

(Nb+V): 0.05 to 0.10% by weight, V/Nb=2 to 5

Nb and V are primary elements of the present invention and because as is clear from the above-described experimental result, when the content of (Nb+V) exceeds 0.05% by weight, the r value is improved and the Δr becomes small, whereby the formability is remarkably improved, the lower limit of (Nb+V) is defined to be 0.05% by weight. On the other hand, because when the content exceeds 0.10% by weight, the surface gloss after de-scaling greatly lowered to cause a problem for a practical use, the upper limit is defined to be 0.10% by weight. On the other hand, about V/Nb, from the point of the anti-ridging property, the range thereof is from 2 to 5, wherein the characteristics are improved.

Mo: not more than 2.0% by weight, Cu: not more than 1.0% by weight, Ni: not more than 1.0% by weight Mo, Cu, and Ni are effective elements for improving the corrosion resistance of the stainless steel and when the addition amounts of them are increased, the corrosion resistance is improved. However, the addition of a large amount of Mo is accompanied by lowering of the toughness and the ductility and because when the content of Mo exceeds 2.0% by weight, the influence becomes severe, the upper limit thereof is defined to be 2.0% by weight. Also, the addition of a large amount of Cu is accompanied by the hot brittleness and because when the content thereof exceeds 1.0% by weight, the influence thereof becomes severe, the upper limit thereof defined to be 1.0% by weight. Furthermore, the addition of a large amount of Ni is accompanied by the formation of an austenite phase at a high temperature region and facilitates the occurrence of lowering of the ductility. Also, because the content thereof exceeds 1.0% by weight, the influence becomes particularly severe, the upper limit is defined to be 1.0% by weight. In addition, when these elements are added singly or as a combination thereof, the similar effect is obtained and thus there is no regulation on the combination of them.

B: from 0.0005 to 0.0030% by weight, Ca: from 0.0007 to 0.0030% by weight, Mg: from, 0.0005 to 0.0030% by weight B, Ca, and Mg are effective elements for preventing clogging an immersion nozzle by the precipitation and attaching of a Ti-based inclusion which is liable to generate at the continues casting of a Ti-containing steel.

Figure 6:
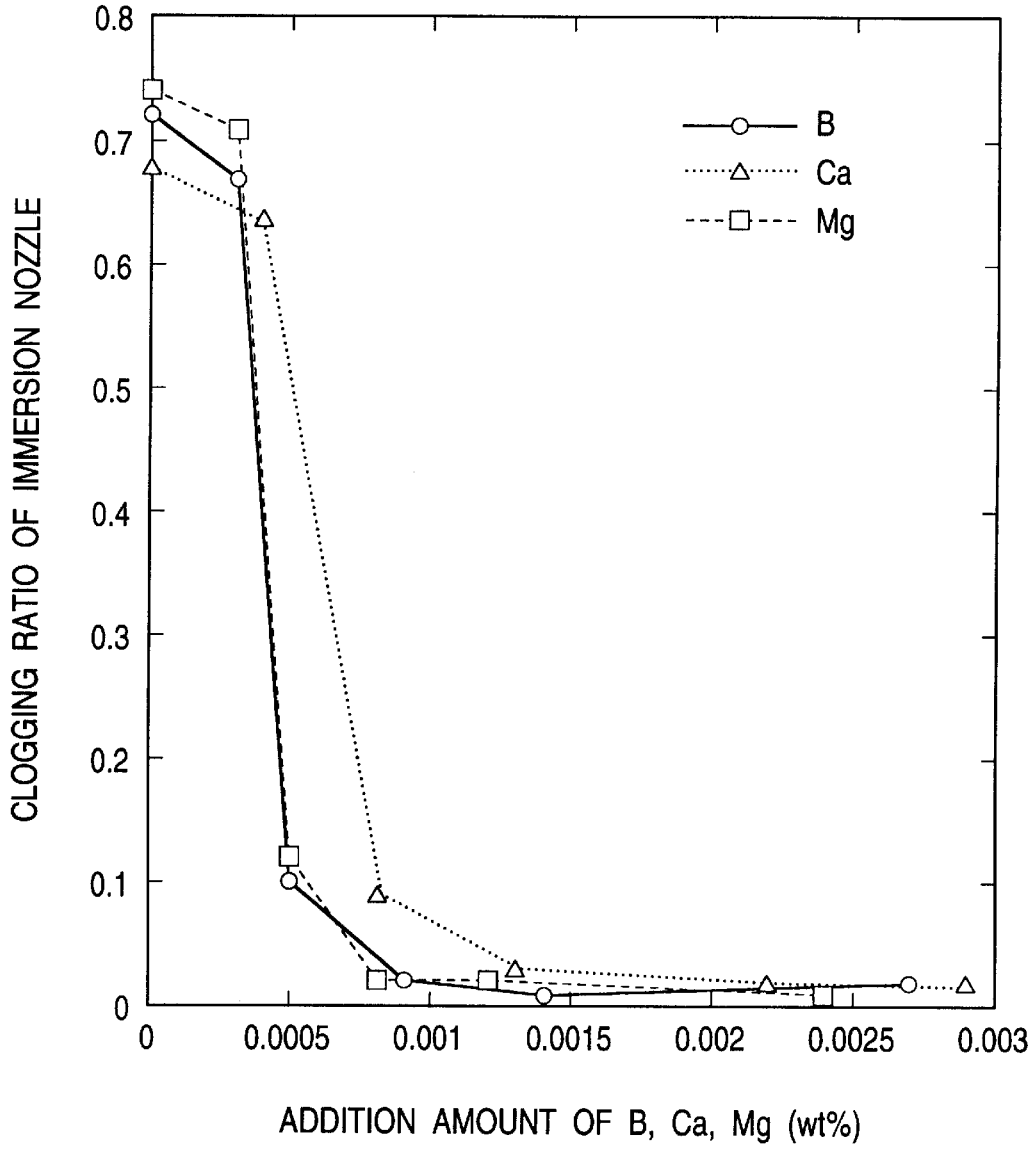
FIG. 6 is a graph showing the relation of the clogging of the immersion nozzle block and the addition amounts of B, Ca, and Mg.

FIG. 6 shows the relation between the clogging of the immersion nozzle block and the addition amounts of B, Ca, and Mg when 160 tons of a slab of about 200 mm in thickness of the steel containing 0.007 wt. % C, 0.2 wt. %

Si, 0.3 wt. % Mn, 0.03 wt. % P, 0.0049 wt. % S, 0.013 wt. % Al, 19 wt. % Cr, 0.19 wt. % Ti, 0.008 wt. % N. 0.02 wt. % Nb, and 0.047 wt. % V and prepared by VOD process is casted by continuous casting method.

From FIG. 6, it can be seen that by adding B in an amount of 0.0005% by weight or more, Ca in an amount of 0.0007% by weight or more, and Mg in an amount of 0.0005% by weight or more, the clogging ratio of the immersion nozzle is greatly lowered. Thus, the lower limits of the addition amounts of B, Mg, and Ca are defined to be 0.0005% by weight, 0.0005% by weight, and 0.0007% by weight respectively. Also, when the addition of these elements are solely or as a combination of them, the same effect is confirmed and thus there is no regulation on the combination of them. However, because the addition of the excessive amount of each of them is accompanied by the deterioration of the corrosion resistance, the upper limit of each of the elements is defined to be 0.0030% by weight.

Slab heating temperature is 1170° C. or lower, finishing a rough rolling temperature is 950° C. or higher:

Because in the steel plate of the present invention, the sufficient formability and anti-ridging property are obtained by adjusting the components only, there is unnecessary for making a specific consideration on the production conditions. However, in the case of requiring a further improvement of the anti-ridging property, it is desirable to employ the following condition in hot rolling.

Figure 7:
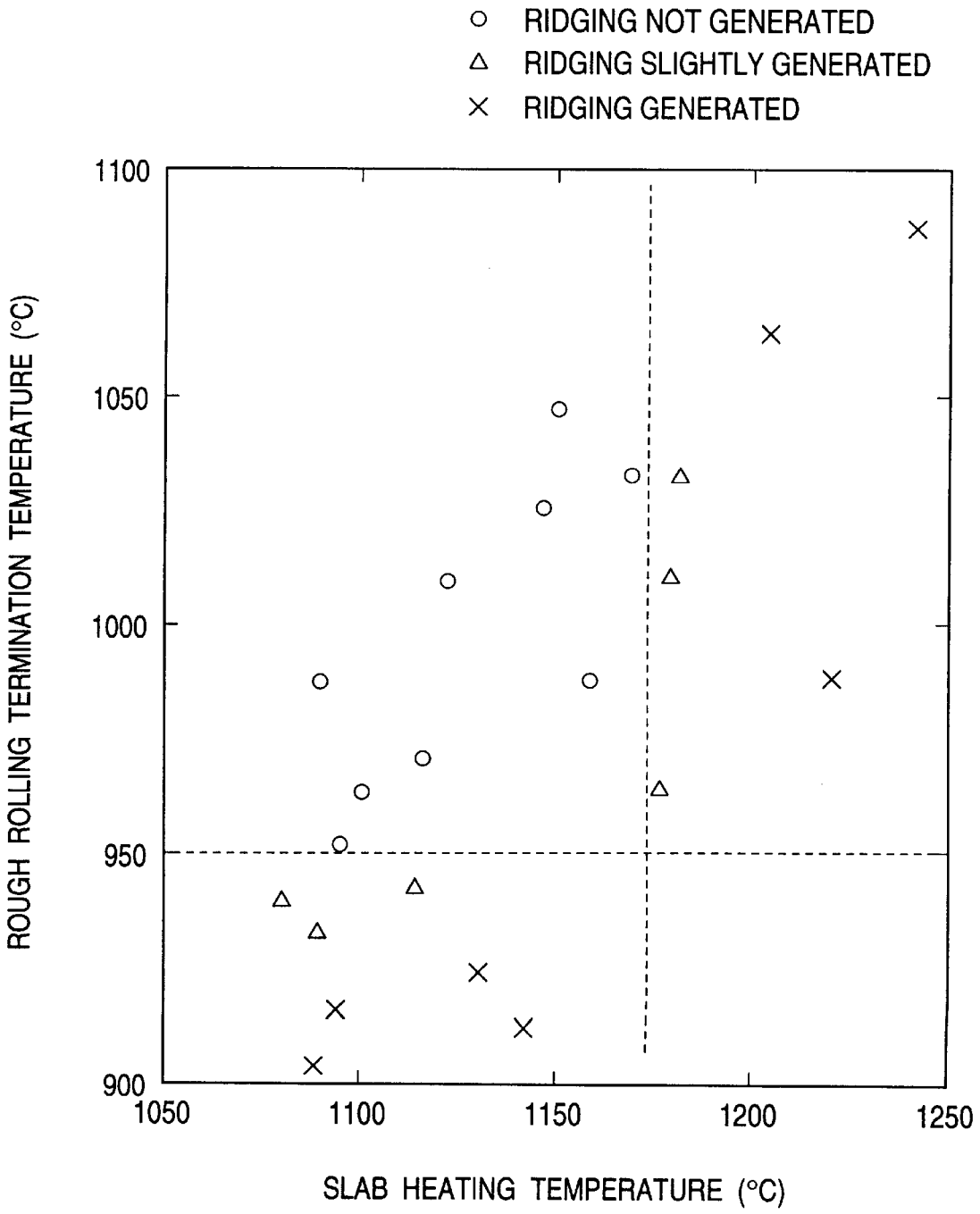
FIG. 7 is a graph showing the relation of the generation of ridging and the hot rolling condition.

That is, in hot rolling, by defining the slab heating temperature to 1170° C. or lowere and finishing a hot rough rolling temperature to 950° C. or higher, the more improvement of the anti-ridging property is obtained. FIG. 7 shows the result of the ridging index adjusted by the slab heating temperature (SRT) and the finishing a rough rolling temperature (RDT), rp/D is 0.15 and h/D is 0.75 in the experimental method used for Experiment 3. From FIG. 7, it can be seen that in the case of carrying out under the conditions of SRT≦1170° C. and RDT≧950° C., no ridging occurs even after the particularly severe drawing work.

In addition, because the lower limit temperature of the slab heating temperature causes no problem if finishing a rough rolling termination temperature of 950° C. or higher is insured, it is unnecessary to particularly determine the lower limit temperature.

EXAMPLE

The present invention and the effects thereof are described below based on the following example.

Each of the steels having the compositions shown in Table 1 was subjected to a VOD method and then a continuous casting step to for a continuously cast slab of 200 mm in thickness and by a hot rolling mill constituted by a rough rolling mill composed of 3 stands and a continuous-type finish-rolling mill composed of 7 stands, the slab was rolled to a hot-rolled steel strip of 4 mm in thickness at a slab heating temperature (SRT) of from 1150 to 1180° C., finishing a rough rolling temperature (RDT) of from 940 to 1090° C., and a finish rolling termination temperature (FDT) of from 800 to 950° C. The hot-rolled steel strip was continuously annealed at a temperature of from 880 to 1000° C., and after pickling, by cold rolling, a steel strip of 0.8 mm in thickness was obtained. After degreasing, the cold-rolled steel strip was subjected to continuous finish annealing at a temperature of from 880 to 1000° C., and after pickling, a skin pass was applied to the steel to provide a stainless steel plate of a 2B finish (the surface finish regulated by JIS G 4307). A sample was obtained from each of the cold rolled and annealed plates obtained by the above-described method and was subjected to the various tests shown below.

Formability:

From the L, D, and C directions of each of the steel plates, tensile test pieces (JIS No. 13 B) were sampled, 15% tensile strain was applied thereto, the plastic strain ratio of each direction was measured, and from the equations described above, the r value and the Ar were calculated.

Ridging index:

From the L direction of each steel plate, a tensile test piece of JIS No. 5 was sample and extent of the ridging after applying a 25% tensile strain was evaluated. The evaluation method was carried out by showing as an index the result obtained by visually comparing with a standard sample. The smaller numeral value means that extent of the ridging is less.

Surface gloss of steel plate:

The surface gloss was measured according to JIS Z-8741 at a light source incident angle of 20°. The evaluation was carried out by the glossiness (GS) and the larger value means that the gloss is better.

Corrosion resistance:

The evaluation of the corrosion resistance was carried out by measuring a pitting potential in an aqueous NaCl solution according to JIS G-0577. The larger pitting potential means that the corrosion resistance is better.

The measurement results of these tests are shown in Table 2. From the results shown in the table, it can be seen that in the steel plates that Ti/N is not less than 12, Nb+V is from 0.05 to 0.1 wt. %, and V/Nb is from 2 to 5 corresponding to the present invention, the r value is large, the Ar is small, and further the anti-ridging property is remarkably improved. Also, it is clear that the steel plates of the present invention are excellent in the surface glossiness. Furthermore, it can seen that in the steel plates added with Ni, Mo, and Cu to improve the corrosion resistance, the corrosion resistance is improved.

INDUSTRIAL APPLICABILITY

As described above, according to the present invention, by optimizing the addition amounts of the addition elements in the ferritic stainless steel, particularly Ti, N, Nb, and V, the ferritic stainless steel plate excellent in the formability and the anti-ridging property in severe working can be provided. (claims 1 and 2) Furthermore, by optimizing the addition amounts of Mo, Ni, and Cu, the ferritic stainless steel plate having the more excellent corrosion resistance and the good toughness and ductility can be provided. (claims 3 and 5)

Moreover, by the addition of slight amounts of B, Ca, and Mg. Clogging of an immersion nozzle by the precipitation and attaching of Ti-based inclusions, which is liable to occur at continuous casting of a Ti-containing steel, can be prevented. (claims 4 and 5)

Also, at the production of the above-described ferritic stainless steel plate, by optimizing the hot rolling condition, the ferritic stainless steel stainless steel plate more excellent in the anti-ridging property can be produced. (claim 9)

TABLE 1

| Steel No. | C | Si | Mn | P | S | Cr | Al | N | O | Ti | Nb | V | Ti/N | Nb + V | V/Nb | Others | Remarks* |
|---|---|---|---|---|---|---|---|---|---|---|---|---|---|---|---|---|---|
| 1 | 0.005 | 0.15 | 0.33 | 0.029 | 0.004 | 16.4 | 0.025 | 0.007 | 0.0051 | 0.14 | 0.019 | 0.047 | 20 | 0.066 | 2.4737 | — | Ex. |
| 2 | 0.006 | 0.18 | 0.34 | 0.031 | 0.005 | 16.3 | 0.034 | 0.008 | 0.0027 | 0.07 | 0.021 | 0.051 | 8.75 | 0.072 | 2.4286 | — | Com. Ex. |
| 3 | 0.005 | 0.14 | 0.36 | 0.032 | 0.003 | 16.3 | 0.004 | 0.007 | 0.0038 | 0.13 | 0.007 | 0.015 | 18.5714 | 0.022 | 2.1429 | — | Com. Ex. |
| 4 | 0.006 | 0.13 | 0.29 | 0.022 | 0.006 | 16.2 | 0.029 | 0.007 | 0.0045 | 0.14 | 0.055 | 0.034 | 20 | 0.089 | 0.6182 | — | Com. Ex. |
| 5 | 0.007 | 0.14 | 0.33 | 0.027 | 0.002 | 16.1 | 0.055 | 0.008 | 0.0033 | 0.15 | 0.059 | 0.122 | 18.75 | 0.181 | 2.0678 | — | Com. Ex. |
| 6 | 0.019 | 0.16 | 0.31 | 0.024 | 0.002 | 16.3 | 0.017 | 0.009 | 0.0055 | 0.16 | 0.022 | 0.07 | 17.7778 | 0.092 | 3.1818 | — | Com. Ex. |
| 7 | 0.009 | 0.31 | 0.46 | 0.021 | 0.001 | 17.5 | 0.023 | 0.01 | 0.0022 | 0.20 | 0.021 | 0.059 | 20 | 0.08 | 2.8095 | — | Ex. |
| 8 | 0.009 | 0.24 | 0.49 | 0.022 | 0.002 | 17.6 | 0.022 | 0.009 | 0.0041 | 0.19 | 0.008 | 0.052 | 12.1111 | 0.06 | 6.5 | — | Com. Ex. |
| 9 | 0.004 | 0.34 | 0.51 | 0.019 | 0.005 | 16.5 | 0.049 | 0.011 | 0.0056 | 0.16 | 0.018 | 0.039 | 14.5455 | 0.057 | 2.1667 | Mo: 0.88 | Ex. |
| 10 | 0.005 | 0.32 | 0.49 | 0.021 | 0.004 | 16.4 | 0.047 | 0.011 | 0.0031 | 0.15 | 0.061 | 0.012 | 13.6364 | 0.073 | 0.1967 | Mo: 0.84 | Com. Ex. |
| 11 | 0.009 | 0.08 | 0.11 | 0.028 | 0.003 | 17.7 | 0.017 | 0.007 | 0.0032 | 0.11 | 0.022 | 0.049 | 15.7143 | 0.071 | 2.2273 | Cu: 0.39 | Ex. |
| 12 | 0.008 | 0.09 | 0.09 | 0.027 | 0.002 | 17.6 | 0.011 | 0.016 | 0.0020 | 0.12 | 0.024 | 0.053 | 7.5 | 0.077 | 2.2083 | Cu: 0.41 | Com. Ex. |
| 13 | 0.009 | 0.44 | 0.21 | 0.024 | 0.003 | 13.2 | 0.029 | 0.007 | 0.0015 | 0.14 | 0.018 | 0.039 | 20 | 0.057 | 2.1667 | B: 0.0008 | Ex. |
| 14 | 0.009 | 0.45 | 0.19 | 0.022 | 0.004 | 13.4 | 0.031 | 0.006 | 0.0061 | 0.21 | 0.008 | 0.009 | 35 | 0.017 | 1.125 | B: 0.0007 | Com. Ex. |
| 15 | 0.012 | 0.22 | 0.38 | 0.029 | 0.005 | 16.5 | 0.045 | 0.008 | 0.0064 | 0.21 | 0.022 | 0.048 | 26.25 | 0.07 | 2.1818 | Ca: 0.0009 | Ex. |
| 16 | 0.012 | 0.21 | 0.36 | 0.024 | 0.002 | 16.4 | 0.037 | 0.009 | 0.0025 | 0.22 | 0.055 | 0.023 | 24.4444 | 0.078 | 0.4182 | Ca: 0.0011 | Com. Ex. |
| 17 | 0.008 | 0.34 | 0.31 | 0.028 | 0.005 | 8.2 | 0.008 | 0.009 | 0.0052 | 0.24 | 0.022 | 0.062 | 26.7 | 0.084 | 2.82 | — | Ex. |

(*Remarks: Ex.: Example of this invention, Com. Ex.: Comparative Example)

TABLE 2

| Steel No. | SRT (° C.) | RDT (° C.) | r value | Δ r | Ridging Index | GS (20°) | Pitting Potential (mv vs SCE) |
|---|---|---|---|---|---|---|---|
| 1 | 1160 | 965 | 1.92 | 0.11 | 1 | 884 | 128 |
| 2 | 1170 | 940 | 1.81 | 0.13 | 2 | 901 | 112 |
| 3 | 1160 | 950 | 1.74 | 0.41 | 1.5 | 879 | 122 |
| 4 | 1180 | 970 | 1.9 | 0.17 | 2 | 894 | 124 |
| 5 | 1160 | 980 | 1.93 | 0.14 | 1 | 622 | 127 |
| 6 | 1170 | 1000 | 1.62 | 0.28 | 1 | 867 | 110 |
| 7 | 1150 | 980 | 1.84 | 0.13 | 1 | 903 | 152 |
| 8 | 1180 | 960 | 1.83 | 0.12 | 2 | 879 | 154 |
| 9 | 1150 | 1010 | 1.88 | 0.14 | 1 | 887 | 201 |
| 10 | 1160 | 955 | 1.85 | 0.13 | 2 | 869 | 206 |
| 11 | 1180 | 1030 | 1.81 | 0.15 | 1 | 877 | 203 |
| 12 | 1150 | 1000 | 1.66 | 0.24 | 1 | 859 | 207 |
| 13 | 1150 | 1040 | 1.98 | 0.11 | 1 | 906 | 58 |
| 14 | 1170 | 940 | 1.79 | 0.41 | 1.5 | 912 | 61 |
| 15 | 1160 | 980 | 1.92 | 0.15 | 1 | 875 | 122 |
| 16 | 1170 | 950 | 1.93 | 0.13 | 2 | 867 | 118 |
| 17 | 1140 | 970 | 1.89 | 0.11 | 1 | 887 | 22 |

What is claimed is:

1. A ferritic stainless steel excellent in the deep drawability and the anti-ridging property, containing from 0.001 to 0.015% by weight C, not more than 1.0% by weight Si, not more than 1.0% by weight Mn, not more than 0.05% by weight P, not more than 0.010% by weight S, from 8 to 30% by weight Cr, not more than 0.08% by weight Al, from 0.005 to 0.015% by weight N, not more than 0.0080% by weight O, not more than 0.25% by weight Ti with Ti/N≧12, and from 0.05 to 0.10% by weight (Nb+V) with V/Nb being from 2 to 5.

2. A ferritic stainless steel excellent in the deep drawability and the anti-ridging property of claim 1 wherein the rest is made up of Fe and unavoidable impurities.

3. A ferritic stainless steel excellent in the deep drawability and the anti-ridging property of claim 1 or 2 wherein the ferritic stainless steel further contains one or more kinds selected from not more than 2.0% by weight Mo, not more than 1.0% by weight Ni, and not more than 1.0% by weight Cu.

4. A ferritic stainless steel excellent in the deep drawability and the anti-ridging property of claim 1 or 2 wherein the ferritic stainless steel further contains one or more kinds selected from from 0.0005 to 0.0030% by weight B, from 0.0007 to 0.0030% by weight Ca, and from 0.0005 to 0.0030% by weight Mg.

5. A ferritic stainless steel excellent in the deep drawability and the anti-ridging property of claim 1 or 2 wherein the ferritic stainless steel further contains one or more kinds selected from not more than 2.0% by weight Mo, not more than 1.0% by weight Ni, and not more than 1.0% by weight Cu and also one or more kinds selected from from 0.0005 to 0.0030% by weight B, from 0.0007 to 0.0030% by weight Ca, and 0.0005 to 0.0030% by weight Mg.

6. A ferritic stainless steel excellent in the deep drawability and the anti-ridging property of claim 1 or 2 wherein the content of Cr is from 10 to 30% by weight.

7. A ferritic stainless steel excellent in the deep drawability and the anti-ridging property of claim 1 or 2 wherein the content of Si is from 0.05 to 0.5% by weight.

8. A ferritic stainless steel excellent in the deep drawability and the anti-ridging property of claim 1 or 2 wherein the content of Mn is from 0.05 to 0.5% by weight.

9. A production method of ferritic stainless steel excellent in the deep drawability and the anti-ridging property, which comprises in the case of producing the ferritic stainless steel described in one of claims 1 to 8, heating the steel slab comprising the components described in each claim to a temperature range of 1170° C. or lower, finishing rough hot rolling of the slab at a temperature range of 950° C. or higher, and successively carrying out hot finish-rolling.

* * * * *